United States Patent [19]

Kukes et al.

[11] Patent Number: 4,797,195

[45] Date of Patent: Jan. 10, 1989

[54] THREE ZONE HYDROCRACKING PROCESS

[75] Inventors: Simon G. Kukes, Naperville; L. Charles Gutberlet, Wheaton; Jeffrey T. Miller, Naperville, all of Ill.

[73] Assignee: Amoco Corporation, Chicago, Ill.

[21] Appl. No.: 160,683

[22] Filed: Feb. 26, 1988

[51] Int. Cl.[4] ..... C10G 65/10

[52] U.S. Cl. ..... 208/59; 208/111; 208/112; 208/210; 502/314; 502/315; 502/335; 502/337; 502/64; 502/79; 502/439

[58] Field of Search ..... 208/59, 111, 210, 58, 208/112; 502/66, 73, 84, 305, 314, 315, 64, 79, 439, 335, 337

[56] References Cited

U.S. PATENT DOCUMENTS

| | | | |
|---|---|---|---|
| 3,026,260 | 3/1962 | Watkins | 208/59 |
| 3,563,886 | 2/1971 | Carlson et al. | 208/210 |
| 3,617,486 | 11/1971 | Lewis et al. | 208/59 |
| 3,725,251 | 4/1973 | Alpert et al. | 208/210 |
| 3,796,655 | 3/1974 | Armistead et al. | 208/146 |
| 3,809,644 | 5/1974 | Johnson et al. | 208/210 |
| 3,857,780 | 12/1974 | Gustafson | 208/139 |
| 3,963,600 | 6/1976 | Hilfman | 208/59 |
| 4,017,382 | 4/1977 | Bonnell et al. | 208/210 |
| 4,421,633 | 12/1983 | Shih et al. | 208/59 |
| 4,500,415 | 2/1985 | Simo et al. | 208/59 |
| 4,517,073 | 5/1985 | Ward et al. | 502/66 |
| 4,563,434 | 1/1986 | Ward et al. | 502/66 |
| 4,576,711 | 3/1986 | Ward et al. | 502/74 |
| 4,619,759 | 10/1986 | Myers et al. | 208/210 |
| 4,657,663 | 4/1987 | Gardner et al. | 208/210 |

*Primary Examiner*—Anthony McFarlane

*Attorney, Agent, or Firm*—Ekkehard Schoettle; William H. Magidson; Ralph C. Medhurst

[57] ABSTRACT

Disclosed is a hydrocracking process wherein the feedstock is contacted in a first reaction zone with a first reaction zone catalyst comprising a nickel component and a molybdenum component deposed on a support consisting essentially of a refractory inorganic oxide. The effluent from the first reaction zone is then contacted in a second reaction zone with a second reaction zone catalyst comprising a nickel component and a tungsten component deposed on a support component consisting essentially of an alumina component and a crystalline molecular sieve component. The effluent from the second reaction zone effluent is then contacted in a third reaction zone with a third reaction zone catalyst comprising a cobalt component and a molybdenum component deposed on a support component comprising a silica-alumina component and a crystalline molecular sieve component.

16 Claims, No Drawings

THREE ZONE HYDROCRACKING PROCESS

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products.

Hydrocracking catalysts generally comprise a hydrogenation component on an acidic cracking support. More specifically, hydrocracking catalysts comprise a hydrogenation component selected from the group consisting of Group VIB metals and Group VIII metals of the Periodic Table of Elements, their oxides or sulfides. The prior art has also taught that these hydrocracking catalysts contain an acidic support comprising a crystalline aluminosilicate material such as X-type and Y-type aluminosilicate materials. This crystalline aluminosilicate material is generally suspended in a refractory inorganic oxide such as silica, alumina, or silica-alumina.

Regarding the hydrogenation component, the preferred Group VIB metals are tungsten and molybdenum; the preferred Group VIII metals are nickel and cobalt. The prior art has also taught that combinations of metals for the hydrogenation component, expressed as oxides and in the order of preference, are: $NiO-WO_3$, $NiO-MoO_3$, $CoO-MoO_3$, and $CoO-WO_3$. Other hydrogenation components broadly taught by the prior art include iron, ruthenium, rhodium, palladium, osmium, indium, platinum, chromium, vanadium, niobium, and tantalum.

References that disclose hydrocracking catalysts utilizing nickel and tungsten as hydrogenation components, teach enhanced hydrocracking activity when the matrix or catalyst support contains silica-alumina. For instance, U.S. Pat. Nos. 4,576,711, 4,563,434, and 4,517,073 all to Ward et al., show at Table V thereof that the lowest hydrocracking activity is achieved when alumina is used in the support instead of a dispersion of silica-alumina in alumina. The lowest hydrocracking activity is indicated by the highest reactor temperature required to achieve 60 vol. % conversion of the hydrocarbon components boiling above a predetermining end point to below that end point.

Similarly, U.S. Pat. No. 3,536,605 to Kittrell et al. teaches the use of silica-alumina in the catalyst support when a nickel- and tungsten-containing hydrogenation component is employed.

U.S. Pat. No. 3,598,719 to White teaches a hydrocracking catalyst that can contain 0 wt. % silica, however, the patent does not present an example showing the preparation of a catalyst devoid of silica nor does the patent teach the preferential use of nickel and tungsten as hydrogenation metals.

As can be appreciated from the above, there is a myriad of catalysts or catalyst systems known for hydrocracking whose properties vary widely. A catalyst suitable for maximizing naphtha yield may not be suitable for maximizing the yield of turbine fuel or distillate. Further, various reactions; i.e., denitrogenation, hydrogenation, and hydrocracking must be reconciled in a hydrocracking process in an optimum manner to achieve the desired results.

For instance when a feedstock having a high nitrogen content is exposed to a hydrocracking catalyst containing a high amount of cracking component the nitrogen serves to poison or deactivate the cracking component. Thus, hydrodenitrogenation catalysts do not possess a high cracking activity since they are generally devoid of a cracking component that is capable of being poisoned. Another difficulty is presented when the hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatics content. This is due to the undesirable smoke production caused by the combustion of aromatics in diesel engines and jet engines.

Prior art processes designed to convert high nitrogen content feedstocks are usually two stage processes wherein the first stage is designed to convert organic nitrogen compounds to ammonia prior to contacting with a hydrocracking catalyst which contained a high amount of cracking component; i.e., a molecular sieve material.

For instance U.S. Pat. No. 3,923,638 to Bertolacini et al. discloses a two catalyst process suitable for converting a hydrocarbon containing substantial amounts of nitrogen to saturated products adequate for use as jet fuel. Specifically, the subject patent discloses a process wherein the hydrodenitrogenation catalyst comprises as a hydrogenation component a Group VIB metal and Group VIII metal and/or their compounds and a cocatalytic acidic support comprising a large-pore crystalline aluminosilicate material and refractory inorganic oxide. The hydrocracking catalyst comprises as a hydrogenation component a Group VIB metal and a Group VIII metal and/or their compounds, and an acidic support of large-pore crystalline aluminosilicate material. For both hydrodenitrogenation catalyst and the hydrocracking catalyst, the preferred hydrogenation component comprises nickel and tungsten and/or their compounds and the preferred large-pore crystalline aluminosilicate material is ultrastable, largepore crystalline aluminosilicate material.

In accordance with the present invention it has now been discovered that the naphtha yield of a two reaction zone hydrocracking process can be considerably improved by replacing 1 to 30 wt. % of the first zone hydrocracking catalyst with a non-sieve containing catalyst.

In particular, where a two-zone hydrocracking process involves the initial contact with a catalyst comprising a nickel component and a tungsten component deposed on a support component containing an alumina component and a crystalline molecular sieve component followed by contact with a catalyst comprising a cobalt component and a molybdenum component deposed on a support component containing a silica-alumina component and a crystalline molecular sieve component; if 1 to about 30 wt. % of the first reaction zone catalyst is replaced with a catalyst comprising a nickel component and a molybdenum component deposed on a support containing a refractory inorganic oxide component devoid of a crystalline molecular sieve component the naphtha yield is considerably improved.

An attendant advantage of carrying out this replacement of catalyst in the first zone in accordance with the process of the invention is a reduction in overall catalyst cost since the non-sieve containing catalyst is markedly less expensive than the replaced catalyst. Thus, the present invention provides for a three-zone hydrocracking process wherein the first zone consists of the relatively less expensive catalyst devoid of a crystalline molecular sieve component.

SUMMARY OF THE INVENTION

This invention relates to a process for hydrocracking a hydrocarbon feedstock with hydrogen at hydrocracking conversion conditions in a plurality of reaction zones in series.

Specifically, the feedstock is contacted in a first reaction zone with a first reaction zone catalyst comprising a nickel component and a molybdenum component deposed on a support consisting essentially of a refractory inorganic oxide. The effluent from the first reaction zone is then contacted in a second reaction zone with a second reaction zone catalyst comprising a nickel component and a tungsten component deposed on a support component consisting essentially of an alumina component and a crystalline molecular sieve component. The effluent from the second reaction zone effluent is then contacted in a third reaction zone with a third reaction zone catalyst comprising a cobalt component and a molybdenum component deposed on a support component comprising a silica-alumina component and a crystalline molecular sieve component.

DETAILED DESCRIPTION OF THE INVENTION

The hydrocarbon charge stock subject to hydrocracking in accordance with the process of this invention is suitably selected from the group consisting of petroleum distillates, solvent deasphalted petroleum residua, shale oils and coal tar distillates. These feedstocks typically have a boiling range above about 200° F. and generally have a boiling range between 350° to 950° F. More specifically these feedstocks include heavy distillates, heavy straight-run gas oils and heavy cracked cycle oils, as well as fluidized catalytic cracking unit feeds. The process of the invention is especially suitable in connection with handling feeds that include a light catalytic cycle oil. This light catalytic cycle oil generally has a boiling range of about 350° to about 750° F., a sulfur content of about 0.3 to about 2.5 wt %, a nitrogen content of about 0.01 to about 0.15 wt % and an aromatics content of about 40 to about 90 vol. %. The light catalytic cycle oil is a product of the fluidized catalytic cracking process.

Operating conditions to be used in each hydrocracking reaction zone in the process of the invention include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is naphtha selective with decreased production of light gases.

The process of the present invention is preferably carried out in a plurality of reaction zones where each zone contains a catalyst that is different than the catalyst in the other zones. Each reaction zone can comprise one or a plurality of beds that have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

In the first reaction zone of the present invention the denitrogenation and desulfurization reactions predominate resulting in the production of ammonia and hydrogen sulfide. In present invention, however, there is no removal of this ammonia and hydrogen sulfide by means of an intermediate separation step.

The catalysts used in the process of the present invention comprises a hydrogenation component and a catalyst support.

The hydrogenation component of the catalysts employed in the process of the invention comprise a Group VIB metal component and a Group VIII metal component. These components are typically present in the oxide or sulfide form.

The first reaction zone catalyst hydrogenation component comprises nickel and molybdenum. These metals and/or their compounds are present in the amounts specified below. These amounts are based on the total catalytic composite or catalyst weight and are calculated as the oxides NiO, and $MoO_3$.

| | Broad | Preferred | Most Preferred |
|---|---|---|---|
| NiO, wt. % | 0.5–10 | 1–6 | 1.5–4 |
| $MoO_3$, wt. % | 2–20 | 5–18 | 8–16 |

The above-described hydrogenation component is deposed on a support component consisting essentially of a refractory inorganic oxide. The first reaction zone catalyst support is essentially devoid of a crystalline molecular sieve component. Preferred refractory inorganic oxides are silica-alumina, and alumina.

The hydrogenation component of the second reaction zone catalyst comprises nickel and tungsten and/or their compounds. The nickel and tungsten are present in the amounts specified below. These amounts are based on the total catalytic composite or catalyst weight and are calculated as the oxides, NiO and $WO_3$. In another embodiment of the present invention, the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–10.0 | 0.0–6.0 | 0.0–3.0 |

Another composite or catalyst is the support. The support contains a crystalline molecular sieve material and alumina. The preferred alumina is gamma alumina. The crystalline molecular sieve material is present in an amount ranging from about 10 to about 60 wt. %, preferably from about 25 to about 50 wt % based on total support weight.

Preferably, the crystalline molecular sieve material is distributed throughout and suspended in a porous matrix of the alumina. The use of alumina in the second stage catalyst support is in contradistinction to U.S. Pat. Nos. 4,576,711, 4,563,434, and 4,517,073 to Ward et al. and 3,536,605 to Kittrell et al. which require the presence of silica-alumina matrix material. The use of alumina is preferred in the second stage catalyst because it serves to increase hydrogenation activity as opposed to hydrocracking activity. It is preferable to carry out hydrogenation reactions prior to the hydrocracking reactions because the hydrocracking reaction will take place at a faster rate with hydrogenated reactants.

The hydrogenation component of the third reaction zone catalyst comprises cobalt and molybdenum and/or their compounds, these metals are present in the amounts specified below. These amounts are based on the total catalytic composite or catalyst weight and are calculated as the oxides CoO and $MoO_3$.

| | Broad | Preferred | Most Preferred |
|---|---|---|---|
| CoO, wt. % | 1–6 | 1.5–5 | 2–4 |
| $MoO_3$, wt .% | 3–20 | 6–15 | 8–12 |

The third reaction zone support comprises a crystalline molecular sieve component and a silica-alumina component. The crystalline molecular sieve material is present in an amount ranging from about 10 to 60 wt % and preferably from about 25 to 50 wt %. The use of silica-alumina in the support is preferred because it serves to yield a product containing a higher iso to normal ratio for the pentane fraction thereof.

In all cases the hydrogenation component may be deposited upon the support by impregnation employing heat-decomposable salts of the above-described metals or any other method known to those skilled in the art. Each of the metals may be impregnated onto the support separately, or they may be co-impregnated onto the support. The composites are subsequently dried and calcined to decompose the salts and to remove the undesired anions.

The supports may be prepared by various well-known methods and formed into pellets, beads, and extrudates of the desired size. For example, the crystalline molecular sieve material may be pulverized into finely divided material, and this latter material may be intimately admixed with the refractory inorganic oxide. The finely divided crystalline molecular sieve material may be admixed thoroughly with a hydrosol or hydrogel of the inorganic oxide. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention preferably are selected from the group consisting of faujasite-type crystalline aluminosilicates, and mordenite-type crystalline aluminosilicates. Although not preferred, crystalline aluminosilicates such as ZSM-5, ZSM-11, ZSM-12, ZSM-23, and ZSM-35, and an AMS-1B crystalline molecular sieve can also be used with varying results alone or in combination with the faujasite-type or mordenite-type crystalline aluminosilicate. Examples of a faujasite-type crystalline aluminosilicate are low-alkali metal Y-type crystalline aluminosilicates, metal-exchanged X-type and Y-type crystalline aluminosilicates, and ultrastable, large-poe crystalline aluminosilicate material. Zeolon is an example of a mordenite-type crystalline aluminosilicate.

Ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability in elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt. % sodium) was shown to have a loss in nitrogen-absorption capacity that is less than 2% per wetting, when tested for stability to wetting by subjecting the material to a number of consecutive cycles, each cycle consisting of a wetting and a drying.

The ultrastable, large-pore crystalline aluminosilicate material that is preferred for the catalytic composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-}$(3,745±5 $cm^{-1}$), a band near 3,695 $cm^{-1}$ (3,690±10 $cm^{-1}$), and a band near 3,625 $cm^{-1}$ (3,610±15 $cm^{1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic preferred ultrastable, large-pore crystalline aluminosilicate material that is used in the catalyst of the present invention.

The ultrastable, large-pore crystalline aluminosilicate material is characterized also by an alkaline metal content of less than 1%.

Another example of a crystalline molecular sieve zeolite that can be employed in the catalytic composition of the present invention is a metal-exchanged Y-type molecular sieve. Y-type zeolitic molecular sieves are discussed in U.S. Pat. No. 3,130,007. The metal-exchanged Y-type molecular sieve can be prepared by replacing the original cation associated with the molecular sieve by a variety of other cations accordin to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such a rare earth metal-exchanged Y-type molecular sieve can be employed suitably in the catalytic composition of the present invention. Specific examples of suitable rare earth metals are cerium, lanthanum, and praseodymium.

A zeolitic molecular sieve suitable for use in the present invention, as mentioned above, is a ZSM-5 zeolite. Descriptions of the ZSM-5 composition and its method of preparation are presented by Argauer, et al., in U.S. Pat. No. 3,702,886. This patent is incorporated by reference herein and made a part hereof.

An additional molecular sieve that can be used in the catalytic compositions of the present invention is AMS-1B crystalline borosilicate, which is described in U.S. Pat. No. 4,269,813, which patent is incorporated by reference herein and made a part thereof.

A suitable AMS-1B crystalline borosilicate is a molecular sieve material having the following composition in terms of mole ratios of oxides:

$0.9\pm0.2\ M_{2/n}O:B_2O_3:YSiO_2:ZH_2O$, wherein M is at least one cation having a valence of n, Y is within the range of 4 to about 600, and Z is within the range of 0 to about 160, and providing an X-ray diffraction pattern comprising the following X-ray diffraction lines and assigned strengths:

| d(Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

The catalysts used in the present invention can be used in any form such as pellets, spheres, extrudates, or other shapes having particular cross sections such as a clover leaf, or "C" shape.

In accordance with the process of the invention, the preferred amounts of catalyst in each respective zone are set out below as a percentage range of the overall amount of catalyst used in the process.

| | Broad | Preferred |
|---|---|---|
| Zone 1 | 2–30 | 5–15 |
| Zone 2 | 10–90 | 20–60 |
| Zone 3 | 5–80 | 20–60 |

In a preferred embodiment of the present invention the catalyst situated at the downstream portion of the plurality of reaction zones possesses a small nominal size while the remaining upstream portion of the total amount of catalyst possesses a large nominal size greater than the small nominal size catalyst. Specifically, the small nominal size is defined as catalyst particles having a U.S. Sieve mesh size ranging from about 10 to 16 preferably 10 to 12. The large nominal size catalyst preferably ranges from about 5 to about 7 U.S. Sieve mesh size.

Generally, the small nominal size hydrocracking catalyst is present in an amount ranging from about 5 to 70 wt. % of the total overall amount of catalyst used in this invention. Preferably, this amount ranges from about 10 to about 60 wt. %. Most preferably the third reaction zone consists of 3 catalyst beds wherein the last or most downstream catalyst bed in the third reaction zone contains third reaction zone catalyst having a U.S. Sieve mesh size of about 10 to 12. The remaining two upstream beds in the third reaction zone contain catalyst having a nominal particle size of about 5 to about 7 mesh (U.S. Sieve). In this connection preferably the first reaction zone consists of one catalyst bed wherein the first reaction zone catalyst has a nominal particle size of about 5 to about 7 mesh (U.S. Sieve).

The second reaction zone also consists of one catalyst bed containing second reaction zone catalyst having a nominal particle size of about 5 to about 7 mesh (U.S. Sieve).

The amount of small nominal size hydrocracking catalyst used in the process of the invention can be limited in accordance with the desired overall pressure gradient. This amount can be readily calculated by those skilled in the art as explained in U.S. Pat. Nos. 3,796,655 (Armistead et al.) and 3,563,886 (Carlson et al.)

The present invention is described in further detail in connection with the following Examples, it being understood that these examples are for purposes of illustration and not limitation.

EXAMPLE 1

The process of the invention was compared with an alternative process not utilizing the catalyst of the first zone in accordance with the present invention, namely the catalyst containing Ni and Mo deposed upon an alumina support.

Specifically, the process of the invention was tested in a reactor having catalyst beds loaded as set out below:

| | wt. g. | V., cc | catalyst |
|---|---|---|---|
| bed 1 | 3.38 | 3.98 | NiMo/Al |

-continued

| | wt. g. | V., cc | catalyst |
|---|---|---|---|
| bed 2 | 6.53 | 7.96 | NiW/Al—USY |
| beds 3–5 | 17.44 | 23.88 | CoMo/SiAl—USY |

The comparative process was carried out in a reactor loaded as set out below:

| | wt. g. | V., cc | catalyst |
|---|---|---|---|
| beds 1 and 2 | 9.79 | 11.94 | NiW/Al—USY |
| beds 3–5 | 17.44 | 23.88 | CoMo/SiAl—USY |

All of the catalyst was mixed with inert alundum to improve flow distribution and maintain better temperature control in a catalyst to alundum weight ratio of about 1:2.

The comparative process and the process in accordance with the invention were used to convert a light catalytic cycle oil feedstock to naphtha and distillate products.

Both the comparative process and the process of the invention test runs were carried out on a "once-through" basis at 1250 psig, a WHSV of 1.45 and a hydrogen flow rate of 12,000 SCFB. Temperature was adjusted to maintain 77 wt. % conversion of the feed material boiling above 380° F. to material boiling below 380° F.

Table 1 below sets out the properties of the feedstock used in each test run.

TABLE 1

| Feed Properties | |
|---|---|
| API gravity | 21.9 |
| C, % | 89.58 |
| H, % | 10.37 |
| S, % | 0.55 |
| N, ppm | 485 |
| Total aromatics, wt % | 69.5 |
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the compositions of the respective catalysts. Shell-324 is a commercially available denitrogenation catalyst.

TABLE 2

Properties of Ultracracking Catalysts

| Chemical Composition, wt % | NiMo/Al | NiW/Al/USY | CoMo/SiAl/USY |
|---|---|---|---|
| $MoO_3$ | 19.8 | | 10.55 |
| $WO_3$ | — | 17.78 | — |
| NiO | 3.3 | 1.90 | — |
| CoO | — | — | 2.5 |
| $Na_2O$ | — | .13 | .07 |
| $SO_4$ | — | .29 | .13 |
| Support Composition, wt % | | | |
| Silica | 0 | | 0 |
| Alumina | 100 | 65 | |
| Silica-alumina | 0 | | |
| Crystalline molecular | | | 65 |
| Sieve | 0 | 35 | 35 |
| Surface Properties | | | |
| S.A., $m^2/g$ | 150 | 350 | 384 |
| Unit Cell Size | — | 24.51 | 24.52 |
| Crystallinity, % | — | 94 | 110 |
| Physical Properties | | | |
| Density, $lbs/ft^3$ | 50.0 | 49.7 | 45.5 |
| Crush Strength, lbs/mm | — | 7.4 | 4.5 |
| Abrasion Loss, wt % (1 hr) | — | 1.2 | .4 |

The following Table 3 sets out the selectivities for both the comparative process and the process of the invention corrected to the common conditions of 725° F. and 77 wt. % conversion of the material boiling above 380° F. to material boiling below 380° F. These "corrected selectivities" were calculated from "corrected yields." The method and equations used to calculate the "corrected" yields are set out at U.S. Pat. No. 3,923,638 (Bertolacini et al.) the teachings of which are incorporated by reference.

TABLE 3

| | Comparative | Invention |
|---|---|---|
| Dry Gas | 5.30 | 5.00 |
| Butane | 12.81 | 12.32 |
| Pentane | 11.20 | 10.97 |
| Light Naphtha | 17.29 | 16.80 |
| Heavy Naphtha | 56.45 | 57.91 |
| I/N $C_5$ | 3.07 | 3.36 |
| I/N $C_4$ | 1.34 | 1.26 |

Catalyst activity after 21 days of contact with the feed LCCO (corrected to 77 wt. % conversion) was 729.7° F. for the invention test, and 726° F. for the comparative test. Thus the invention process was slightly less active, but considerably more selective to heavy naphtha at the expense of less valuable products such as dry gas butanes, pentanes, and light naphtha.

EXAMPLE 2

Another specific aspect of the process of the invention was compared with an alternative prior art process.

The reactor used to carry out the process of the invention was loaded as set out below:

| | wt. g. | V., cc | catalyst |
|---|---|---|---|
| bed 1 | 3.38 | 3.98 | NiMo/Al |
| bed 2 | 6.53 | 7.96 | NiW/Al—USY |
| beds 3 and 4 | 11.63 | 15.92 | CoMo/SiAl—USY |
| bed 5 | 5.81 | 7.96 | CoMo/SiAl—USY |

All of the catalyst loaded in beds 1 through 4 possessed a nominal particle size of about ⅛-inch (6 mesh U.S. Sieve). The catalyst loaded in bed 5 possessed a nominal particle size of about 1/16-inch (10–12 mesh U.S. Sieve). The catalysts used in the above set out reactor loading possessed the same compositions as described in the invention run of Example 1 except that the cobalt content of the catalyst in bed 5 was 3.0 wt. %.

The prior art comparative process was carried out in a reactor loaded as set out below:

| | wt. g. | V., cc | catalyst |
|---|---|---|---|
| beds 1 and 2 | 10.15 | 11.94 | NiW/SiAl—USY |
| beds 3–4 | 17.44 | 23.88 | CoMo/SiAl—USY |

All of the catalyst loaded into the reactor possessed a nominal particle size of about ⅛-inch (6 mesh U.S. Sieve). The catalyst containing CoMo/SiAl-USY possessed the same composition as setout is Table 2.

The properties of the NiW/SiAl-USY catalyst are setout below in Table 4.

TABLE 4

| Chemical Composition, wt % | NiW/Al/USY |
|---|---|
| $WO_3$ | 17.60 |
| NiO | 2.13 |
| $Na_2O$ | 0.9 |
| $SO_4$ | 0.21 |
| Support Composition, wt % | |
| Silica-alumina | |
| Crystalline molecular | |
| Sieve | |
| Surface Properties | |
| S.A., $m^2/g$ | 348 |
| Unit Cell Size | 24.52 |
| Crystallinity, % | 105 |
| Physical Properties | |
| Density, $lbs/ft^3$ | 52.8 |
| Crush Strength, lbs/mm | 7.4 |
| Abrasion Loss, wt % (1 hr) | .8 |

Both the reactors were loaded with inert alundum as described in Example 1.

The comparative process and the process of the invention were carried out to convert a light catalytic cycle oil feedstock having the composition set out in Table 1.

Both the comparative process and the process of the invention test runs were carried out on a "once-through" basis at 1250 psig, a WHSV of 1.45 and a hydrogen flow rate of 12,000 SCFB. The reactor temperature was adjusted to maintain 77 wt. % conversion of the feed material boiling above 380° F. to material boiling below 380° F.

The following Table 5 sets out the selectivities for both the comparative process and the process of the invention corrected to the common conditions as described in Example 1 of 725° F. and 77 wt. % conversion.

TABLE 5

| | Comparative | Invention |
|---|---|---|
| Dry Gas | 5.69 | 4.85 |
| Butane | 13.07 | 11.73 |
| Pentane | 11.27 | 10.39 |
| Light Naphtha | 16.61 | 15.97 |
| Heavy Naphtha | 56.36 | 60.06 |

In this example, the comparative process did not utilize the catalysts deposed in zones 1 and 2 in accordance with the present invention. The process of the invention afforded an increase of about 3.7% in heavy naphtha selectivity at the expense of less valuable products such as dry gas, butanes, pentanes, and light naphtha.

After 21 days on stream, the temperature required to maintain 77 wt. % conversion for the comparative run was 734.5° F. while the subject temperature for the invention run was 722.7°, a marked improvement in activity.

What is claimed is:

1. A process for hydrocracking a hydrocarbon feedstock with hydrogen at hydrocracking conversion conditions in a plurality of reaction zones in series which comprises:

(a) contacting said feedstock in a first reaction zone with a first reaction zone catalyst comprising a nickel component and a molybdenum component deposed on a support component consisting essentially of a refractory inorganic oxide;

(b) contacting the effluent from said first reaction zone in a second reaction zone with a second reaction zone catalyst comprising a nickel component and a tungsten component deposed on a support component consisting essentially of an alumina component and a crystalline molecular sieve component; and (c) contacting the effluent from said second reaction zone in a third reaction zone with a third reaction zone catalyst comprising a cobalt component and a molybdenum component deposed on a support component comprising a silica-alumina component and a crystalline molecular sieve component.

2. The process of claim 1 wherein said crystalline molecular sieve component is a Y zeolite.

3. The process of claim 1 wherein said refractory inorganic oxide is alumina.

4. The process of claim 1 wherein a portion of said plurality of reaction zones in series which comprises said first, second, and third reaction zones contains catalyst possessing a small nominal U.S. Sieve mesh size ranging from about 10 to about 16 and the remaining portion of the total amount of catalyst in said plurality of reaction zones located upstream of the catalyst of small nominal particle size, possesses a large nominal particle size greater than said small nominal size.

5. The process of claim 4 wherein said small nominal particle size ranges from about 10 to about 12 and said large nominal particle size ranges from about 5 to about 7 mesh (U.S. Sieve).

6. The process of claim 5 wherein said third reaction zone consists of three beds wherein the most downstream bed contains said small nominal size catalyst.

7. The process of claim 1 wherein said first reaction zone catalyst contains said nickel component said molybdenum component in an amount ranging from about to about 18 wt. % both calculated as oxides and based on total weight of catalyst in said first reaction zone.

8. The process of claim 7 wherein said crystalline molecular sieve component is a Y zeolite.

9. The process of claim 7 wherein said refractory inorganic oxide is alumina.

10. The process of claim 7 wherein a portion of said plurality of reaction zones in series which comprise said first, second, and third reaction zones contains catalyst possessing a small nominal U.S. Sieve mesh size ranging from about 10 to about 16 and the remaining portion of the total amount of catalyst in said plurality of reaction zones located upstream of the catalyst of small nominal particle size, possesses a large nominal particle size greater than said small nominal size.

11. The process of claim 10 wherein said small nominal U.S. Sieve mesh size ranges from about 10 to about 12 and said large nominal size ranges from about 5 to about 7.

12. The process of claim 11 wherein said third reaction zone consists of three beds wherein the most downstream bed contains said small nominal size catalyst.

13. The process of claim 1 wherein said frist reaction zone catalyst contains said nickel component in an amount ranging from about 1.5 to about 4 wt. % and said molybdenum component in an amount ranging from about 8 to about 16 wt. % both calculated as oxides and based on total first reaction zone catalyst weight and wherein said refractory oxide is alumina.

14. The process of claim 13 wherein a portion of the catalyst present in said plurality of reaction zones in series which comprises said first, second and third reaction zones contains catalyst possessing a small nominal U.S. Sieve mesh size ranging from about 10 to about 16 and the remaining portion of the total amount of catalyst in said plurality of reaction zones located upstream of the catalyst of small nominal particle size, possesses a large nomiaal size greater than the small nominal size.

15. The process of claim 14 wqherein said small nominal partical U.S. Sieve mesh size ranges from about 10 to about 12 and said large nominal particle size ranges from about 5 to about 7 mesh (U.S. Sieve).

16. The process of claim 15 wherein said third reaction zone consists of three beds wherein the most downstream bed contains said small nominal size catalyst.

* * * * *

UNITED STATES PATENT OFFICE

CERTIFICATE OF CORRECTION

Patent No. 4,797,195 Dated January 10, 1989

Inventor(s) Simon G. Kukes, L. Charles Gutberlet, Jeffrey T. Miller

It is certified that error appears in the above-identified patent and that said Letters Patent is hereby corrected as shown below:

Patent reads:

| Col. | Line | |
|---|---|---|
| 5 | 12 | "Another composite or catalyst is the support" should be --Another component of the second reaction zone catalytic composite or catalyst is the support.-- |
| 6 | 63 | "$cm^{-}$" should read be --$cm^{-1}$-- |
| 6 | 65 | "$cm^{1}$)." should be --$cm^{-1}$).-- |
| 12 | 47-48 | "component said molybdenum" should be --component in an amount ranging from about 1 to about 6 wt.% and said molybdenum-- |
| 12 | 48-49 | "about to" should be --about 5 to-- |

Signed and Sealed this

Thirteenth Day of November, 1990

*Attest:*

HARRY F. MANBECK, JR.

*Attesting Officer*

*Commissioner of Patents and Trademarks*